US007909638B2

(12) United States Patent
Seo et al.

(10) Patent No.: US 7,909,638 B2
(45) Date of Patent: Mar. 22, 2011

(54) ELECTRICAL CONNECTOR ASSEMBLY HAVING CONNECTOR POSITION ASSURANCE DEVICE

(75) Inventors: Ju Won Seo, Incheon (KR); Joo Hyun Park, Gyeonggi-do (KR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/734,090

(22) PCT Filed: Oct. 10, 2008

(86) PCT No.: PCT/IB2008/055333

§ 371 (c)(1), (2), (4) Date: May 14, 2010

(87) PCT Pub. No.: WO2009/047744

PCT Pub. Date: Apr. 16, 2009

(65) Prior Publication Data

US 2010/0233897 A1 Sep. 16, 2010

(30) Foreign Application Priority Data

Oct. 12, 2007 (WO) ..... PCT/IB2007/055370

(51) Int. Cl.
*H01R 3/00* (2006.01)

(52) U.S. Cl. ..... 439/489; 439/352; 439/357

(58) Field of Classification Search ..... 439/352, 439/489, 357

See application file for complete search history.

(56) References Cited

U.S. PATENT DOCUMENTS

| | | | | |
|---|---|---|---|---|
| 6,261,116 | B1 * | 7/2001 | Ceru | 439/352 |
| 6,312,277 | B1 * | 11/2001 | Holub | 439/352 |
| 6,435,895 | B1 | 8/2002 | Fink et al. | 439/352 |
| 6,780,045 | B2 * | 8/2004 | Hall, Jr. et al. | 439/489 |
| 6,921,279 | B2 * | 7/2005 | Sian et al. | 439/352 |
| 7,399,195 | B2 * | 7/2008 | Kim et al. | 439/352 |

FOREIGN PATENT DOCUMENTS

| | | |
|---|---|---|
| DE | 103 33 076 B4 | 3/2004 |
| EP | 0 709 928 A2 | 5/1996 |

* cited by examiner

*Primary Examiner* — Tho D Ta
(74) *Attorney, Agent, or Firm* — Harrington & Smith

(57) ABSTRACT

An electrical connector assembly includes a first and a second connectors to be mated together, and a Connector Position Assurance (CPA) device installed on one of the first and second connectors. The CPA device is fixed to a pre-lock position when shipped together with said one of the connectors and before the first and second connectors are mated. At the pre-lock position, a locking lever on the second connector can be deformed so that primary locking members of the first and second connectors can be engaged. When the first and second connectors are mated, a rib formed on the first connector acts on a release member provided on the CPA device, to allow the CPA device to move to a final lock position at which, a secondary locking member restricts the movement of the primary locking member of the second connector to prevent the primary locking members from being disengaged.

10 Claims, 9 Drawing Sheets

ELECTRICAL CONNECTOR ASSEMBLY HAVING CONNECTOR POSITION ASSURANCE DEVICE

TECHNICAL FIELD

The present invention relates to an electrical connector assembly. In particular, it relates to an electrical connector assembly having a Connector Position Assurance (CPA) device.

BACKGROUND

In certain industrial applications, electrical connectors are required to be securely connected to each other. These electrical connecter are typically provided with locking features such as latches to lock the connector housings to each other. In addition, a Connector Position Assurance (CPA) device is provided to lock the locking members as an additional locking assurance.

When a connector is connected to a counterpart connector and that the latches are engaged to each other, the CPA device is installed to the connector assembly at a final locking position to lock the latches, so as to secure the locking status of the connectors. However, the CPA device may be placed to the final locking position before the two connectors are connected, which may cause difficulties and/or inconvenience to connect the two connectors correctly.

There is therefore a need to provide a connector assembly with a CPA device which can be installed and shipped together with one of the connectors. The CPA device is fixed to the connector housing in a pre-locking position and will not move to the final locking position until the two mating connectors are mated together and require locking security assurance function by the CPA device.

SUMMARY OF INVENTION

Embodiments of the present invention provide an electrical connector assembly having a first connector and a second connector to be mated together, and a Connector Position Assurance (CPA) device installed on one of the first and second connectors. The CPA device is fixed to a pre-lock position when shipped together with said one of the connectors and before the first and second connectors are mated. At the pre-lock position, a locking lever on the second connector can be deformed so that primary locking members of the first and second connectors can be engaged. When the first and second connectors are mated, a rib formed on the first connector acts against a release member provided on the CPA device, to allow the CPA device to move to a final lock position. At the final-lock position, a secondary locking member of the CPA device restricts the movement of the primary locking member of the second connector, so as to prevent the primary locking members from being disengaged.

Other aspects and advantages of the present invention will become apparent from the following detailed description, taken in conjunction with the accompanying drawings, illustrating by way of example the inventive concept of the present invention.

BRIEF DESCRIPTION OF THE DRAWINGS

These and other aspects and advantages of the present invention will be described in detail with reference to the accompanying drawings, in which.

DETAILED DESCRIPTION OF THE PREFERRED EMBODIMENTS

Figure 1A:
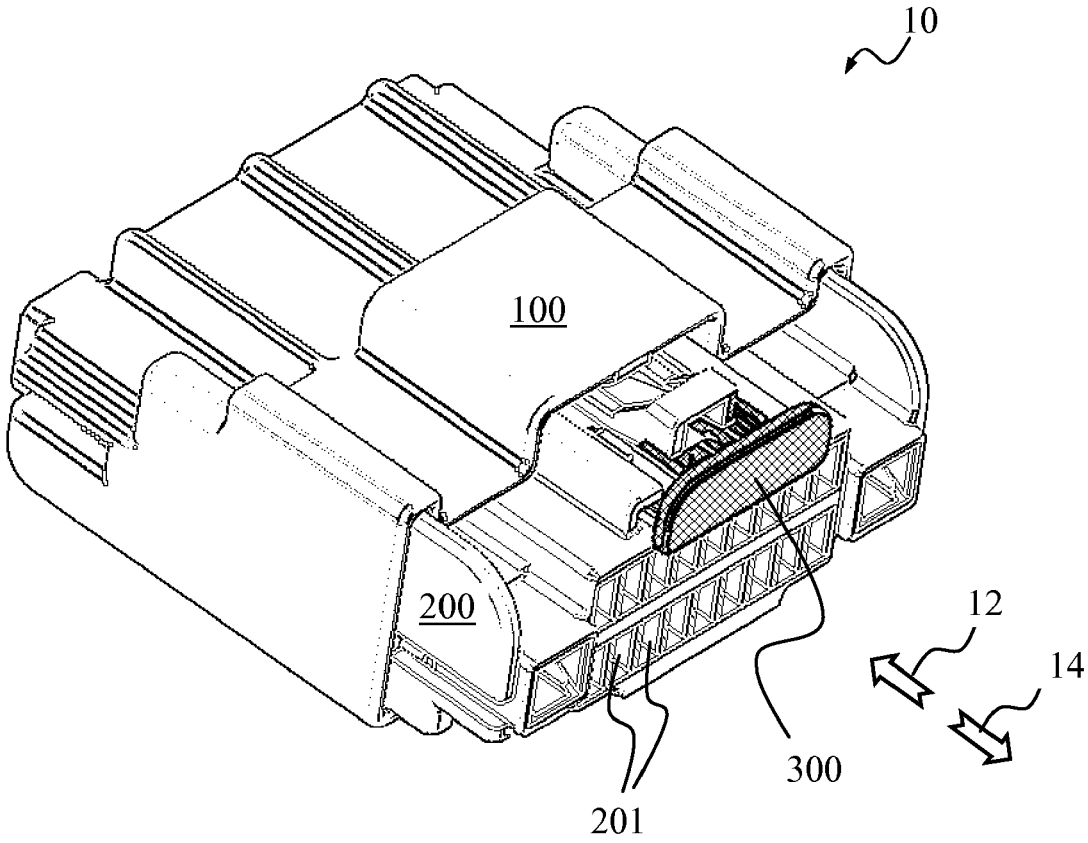
FIG. 1A is a schematic perspective view showing an electrical connector assembly according to one embodiment of the present invention.

As shown in FIG. 1A, an electrical connector assembly 10 according to one embodiment of the present invention has a first connector 100, a second connector 200, both shown as connector housings, which can be mated to each other, and a Connector Position Assurance (CPA) device 300 moveably coupled to second connector housing 200. Compartments 201 are provided on second connector housing 200, into which contact terminals (not shown) are placed. CPA device 300 is slidable relative to second connector housing 200 along forward/backward directions 12 and 14.

Figure 1B:
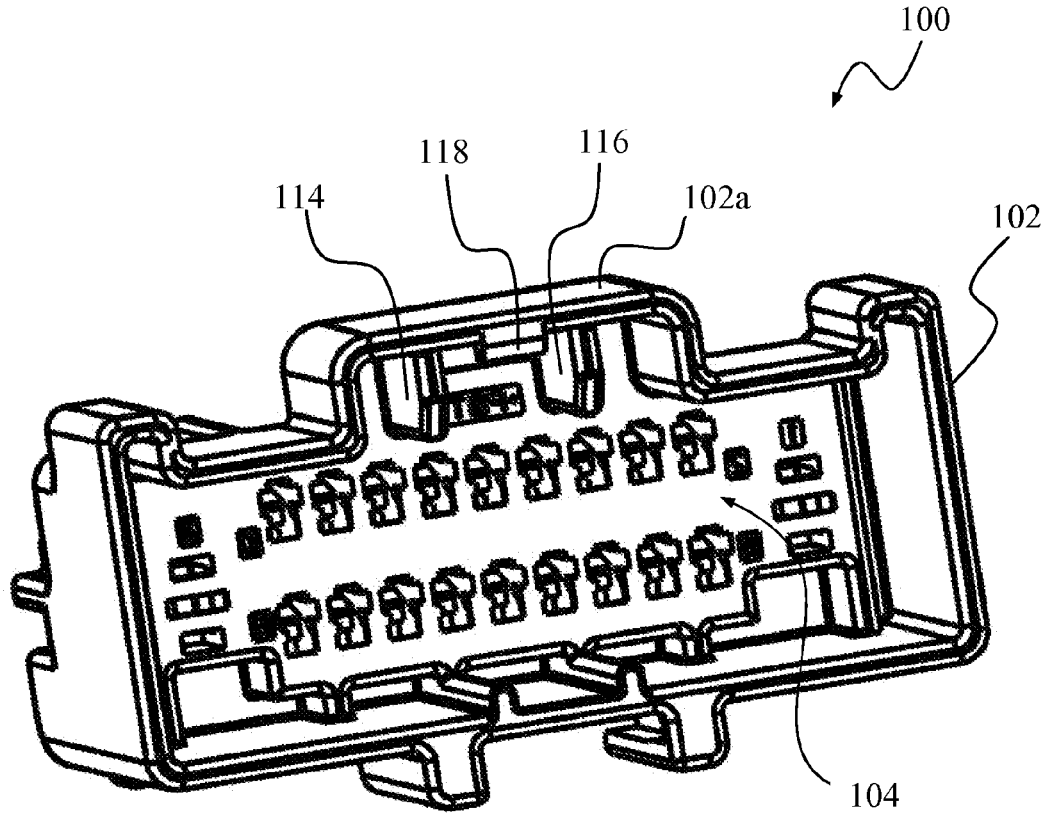
FIG. 1B is a schematic perspective view showing a first connector of the connector assembly shown in FIG. 1A.

FIG. 1B shows first connector housing 100 of connector assembly 10 shown in FIG. 1A. First connector housing 100 has side walls 102 surrounding a cavity 104. A first latch member 118 and a pair of ribs 114, 116 are formed on top side wall 102*a* and protruding inward into cavity 104.

Figure 1C:
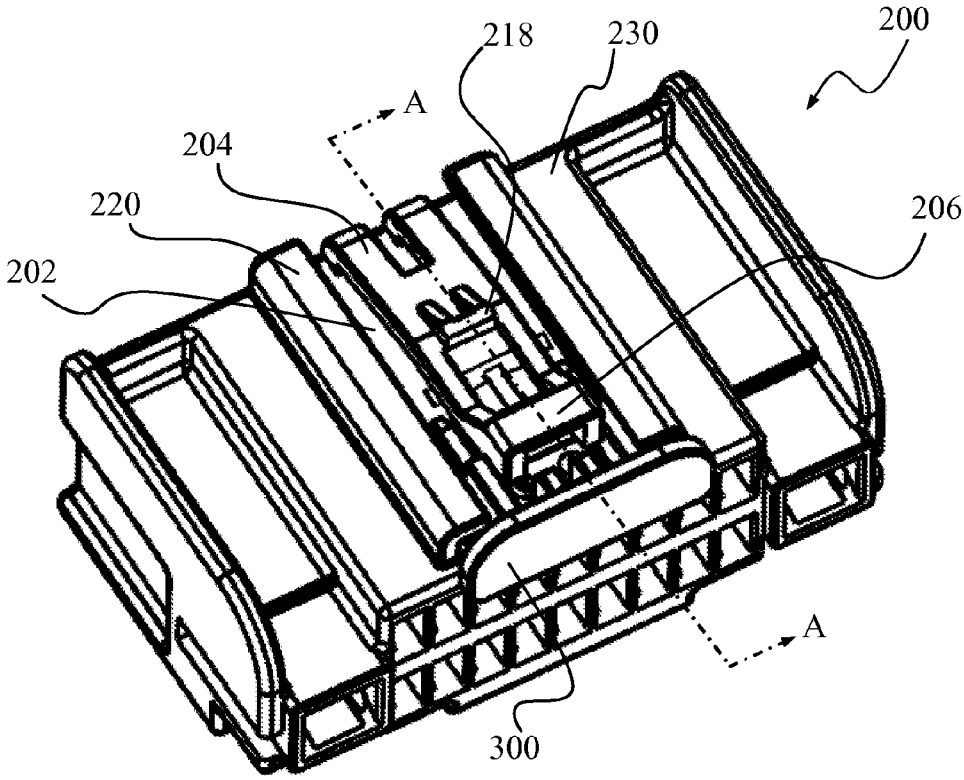
FIG. 1C is a schematic perspective view showing a second connector of the connector assembly shown in FIG. 1A, with a CPA device coupled thereon.

FIG. 1C shows second connector housing 200 of connector assembly 10 shown in FIG. 1A. Second connector housing 200 has a pair of guiding rails 220, 230 along which CPA device 300 is slidably coupled to second connector housing 200. Second connector housing 200 has a locking lever 204 formed integral from a base portion 202, with a second latch member 218 and a release button 206 structured such that, when release button 206 is pressed, locking lever 204 and second latch member 218 can be elastically deformed towards base portion 202.

Figure 2:
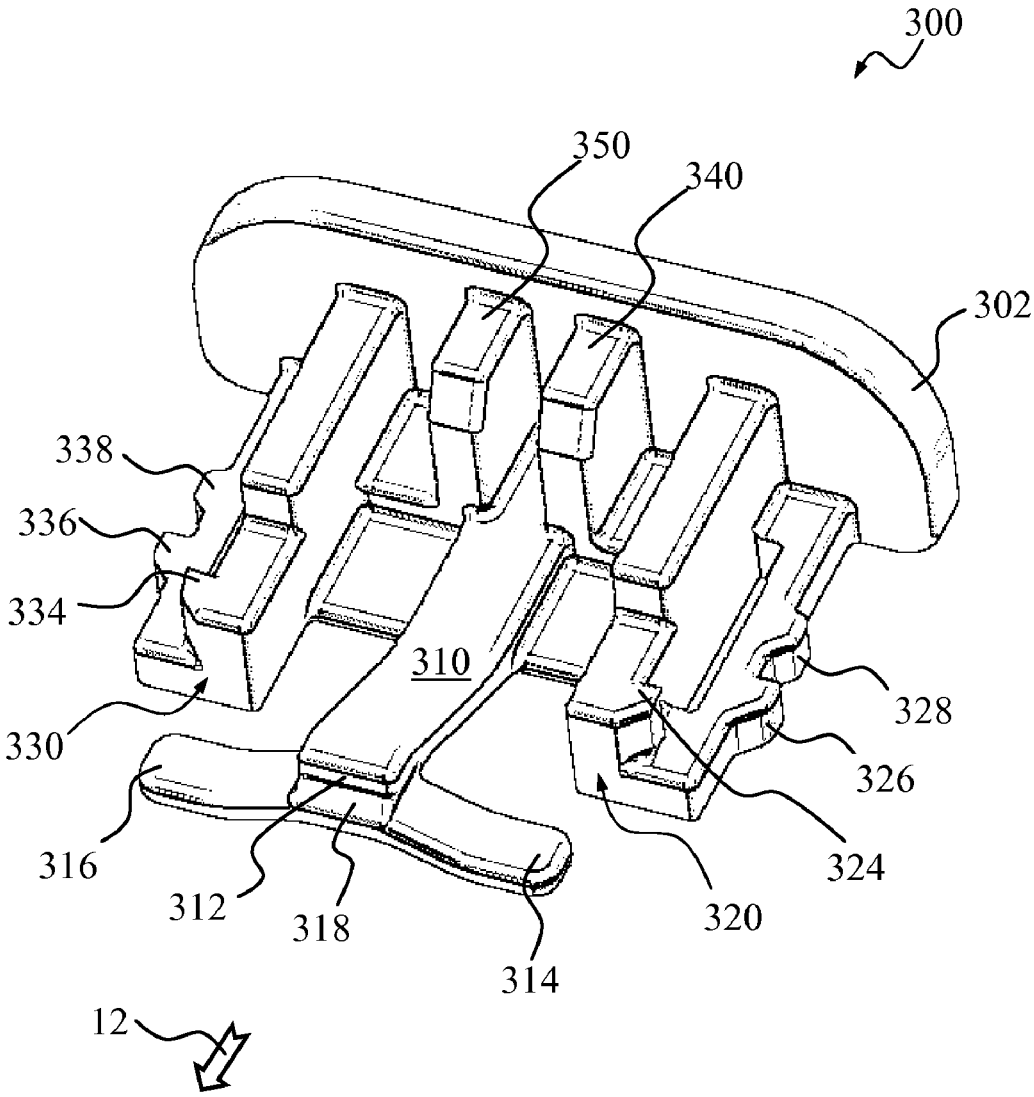
FIG. 2 is a schematic perspective view showing a CPA device of a connector assembly shown in FIG. 1A.

FIG. 2 shows CPA device 300 in further detail. CPA device 300 is formed of an integral part, by molding for example. CPA device 300 has a base portion 302, a center prong 310 extending forwardly and perpendicularly from base portion 302, in a cantilevered manner. First and second arms 320, 330 extend forwardly and perpendicularly from base portion 302 and at each side of center prong 310. At a front end portion 318 of center prong 310, away from base portion 302 and slightly raised from center prong 310, there is formed a step 312 facing forward direction 12, and a pair of lateral prongs 314, 316 extending perpendicularly from front end 318 of center prong 310. Two additional projections 340 and 350 may also be formed on base 302.

Formed on a side of first arm 320 there are first pre-lock protrusions or lugs 324, 326 and first final-lock protrusion or lug 328. Likewise, second pre-lock protrusions or lugs 334, 336 and second final-lock protrusion or lugs 338 are formed on a side of second arm 330.

Figure 3A:
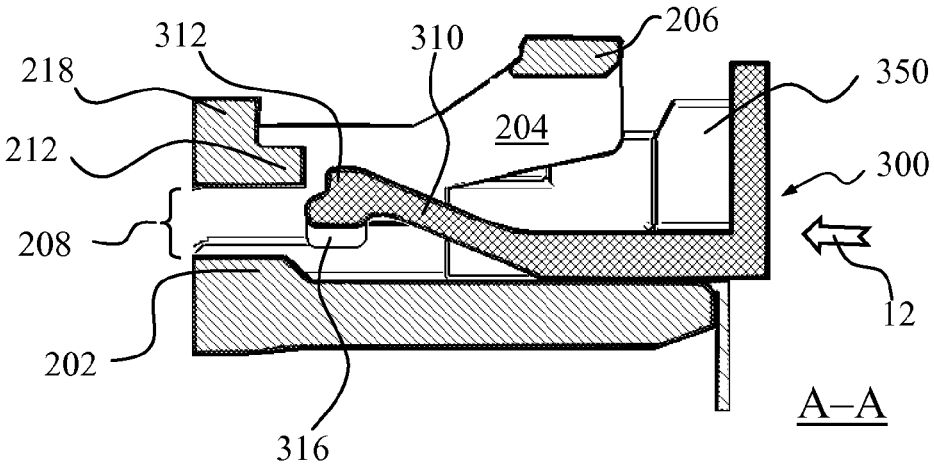
FIG. 3A is a partial cross-sectional side view of FIG. 1C
Figure 3B:
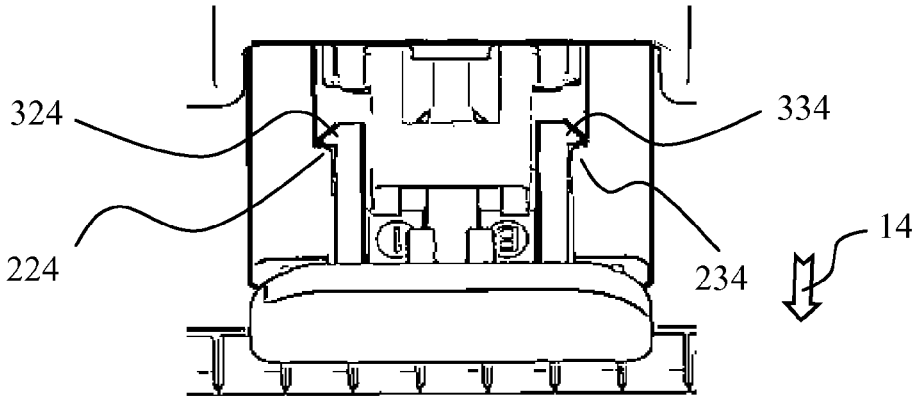
FIG. 3B is a partial top view of FIG. 1C.
Figure 3C:
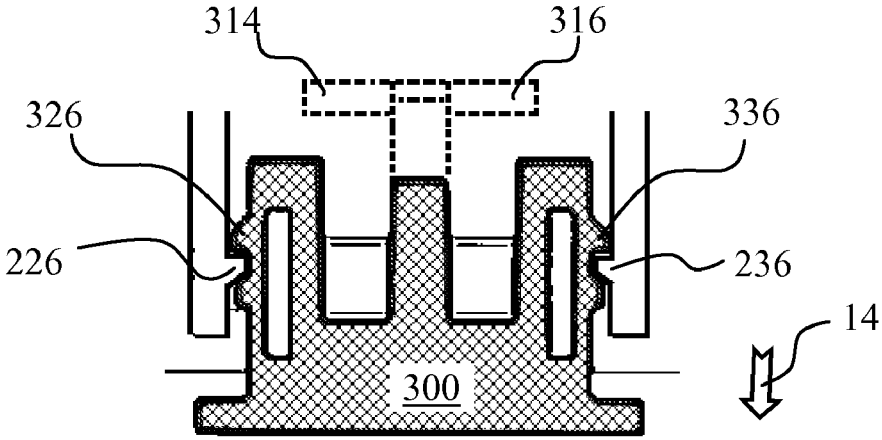
FIG. 3C is a partial cross-sectional top view of FIG. 3A.

FIG. 3A is a partial cross-sectional side view, along a longitudinal section depicted by A-A in FIG. 1C. Before first and second connector housings 100 and 200 are mated, CPA device 300 is coupled to second connector housing 200, in a pre-lock position. At the pre-lock position, a stopper 212 formed on locking lever 204 and step 312 of CPA device 300 face each other by which, stopper 212 blocks CPA device 300 from moving further towards front direction 12. In addition, as shown in FIGS. 3B and 3C, first pre-lock lugs 324, 326, 334 and 336 of CPA device 300 engage with respective steps 224, 234 and lateral protrusions 226, 236 of second connector housing 200. By virtue of these engagements, CPA device 300 is prevented from moving along backward direction 14. CPA device 300 can now be fixed to second connector housing 200 at the pre-lock position. This allows the second connector to be manufactured and shipped together with a CPA device fixed to the pre-lock position. This configuration can prevent the CPA device from being placed apart from the second connector, and missing of the CPA device can be avoided.

At the pre-lock position, as shown in FIG. 3A, there remains a gap 208 between second latch member 218 and base portion 202 of second connector housing 200. Second latch member 218 can therefore be allowed to move downward, when press button 206 is pressed. As such, the CPA device will not be misplaced to affect mating of the first and second connectors.

Figure 3D:
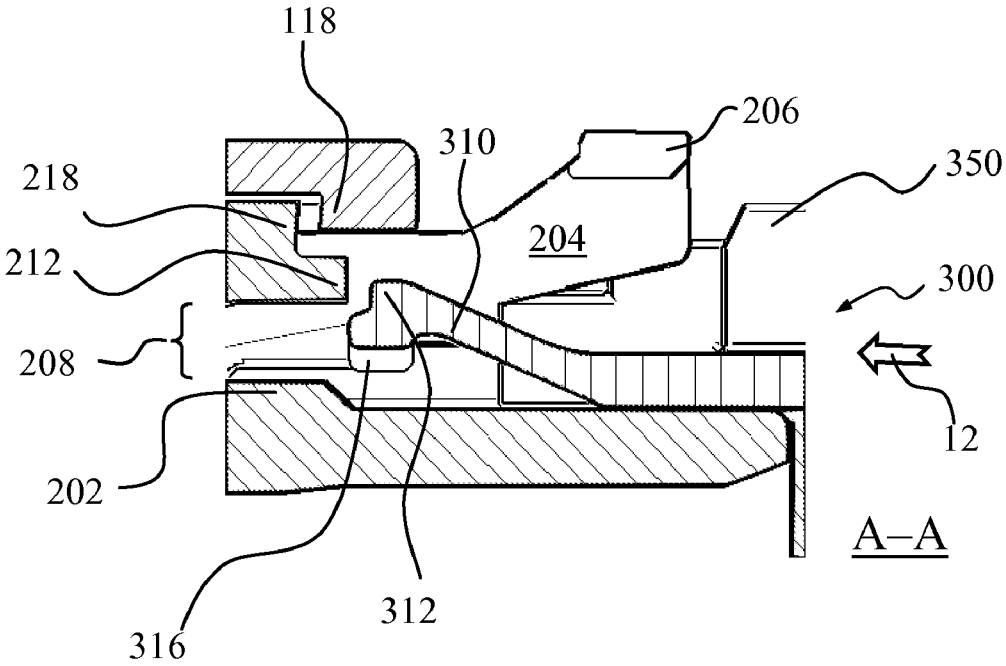
FIG. 3D is a partial cross-sectional side view showing the two connectors are mated and the CPA device is at the pre-lock position.

When first and second connector housings 100 and 200 are to mate with each other, press button 206 is pressed downward, causing second latch member 218 to move downward. This will allow second latch member 218 to pass underneath first locking projection 118. When press button 206 is released, locking lever 204 springs back, and second latch member 218 to act against first latch member 118. First and second connector housings 100 and 200 can therefore be locked to each other by the engagement of first and second latch members 118 and 218, as shown in FIG. 3D.

Figure 4A:
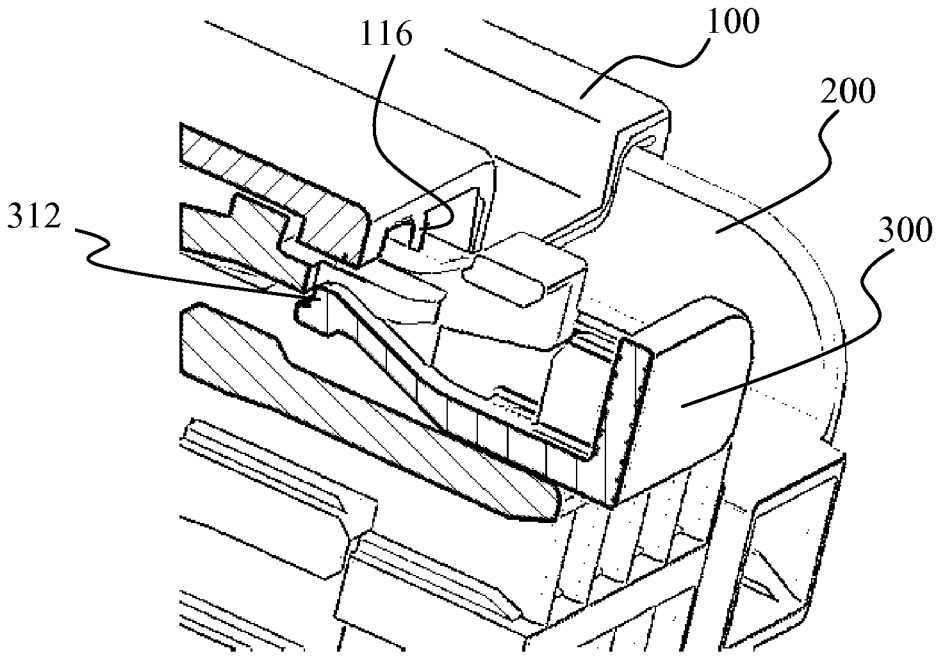
FIG. 4A is a partial perspective cross-sectional view showing a connector assembly of FIG. 1A when the CPA device is at the pre-lock position.
Figure 4B:
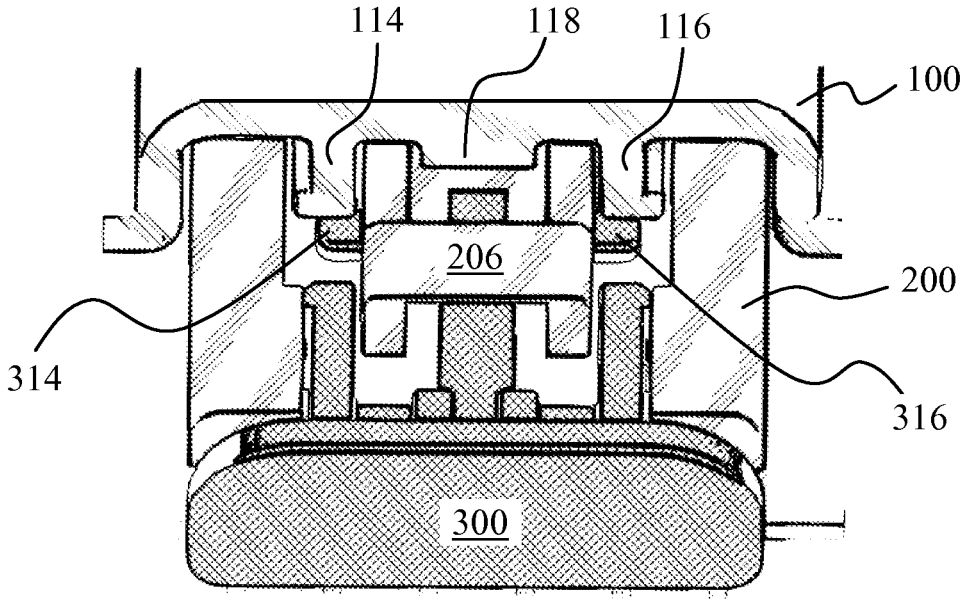
FIG. 4B is a partial perspective top view of FIG. 4A.

Mating of first and second connector housings 100 and 200, i.e. when second connector housing 200 is inserted into cavity 204, ribs 114 and 116 of first connector housing 100 urge against lateral prongs 314, 316 of CPA device 300, as shown in FIGS. 4A and 4B. Ribs 114 and 116 therefore press lateral prongs 314 and 316 downward. Accordingly, center prong 310 is deflected with front end 318 brought downward, causing step 312 to move away from the blockage of stopper 212. This allows CPA device 300 to move further along forward direction 12, and with front end 318 placed within the clearance gap 208, i.e., between second latch member 218 and base portion 202 of second connector housing 200. By placing front end 318 between second protrusion 218 and base portion 202, CPA device 300 is moved to a final-lock position.

Figure 5A:
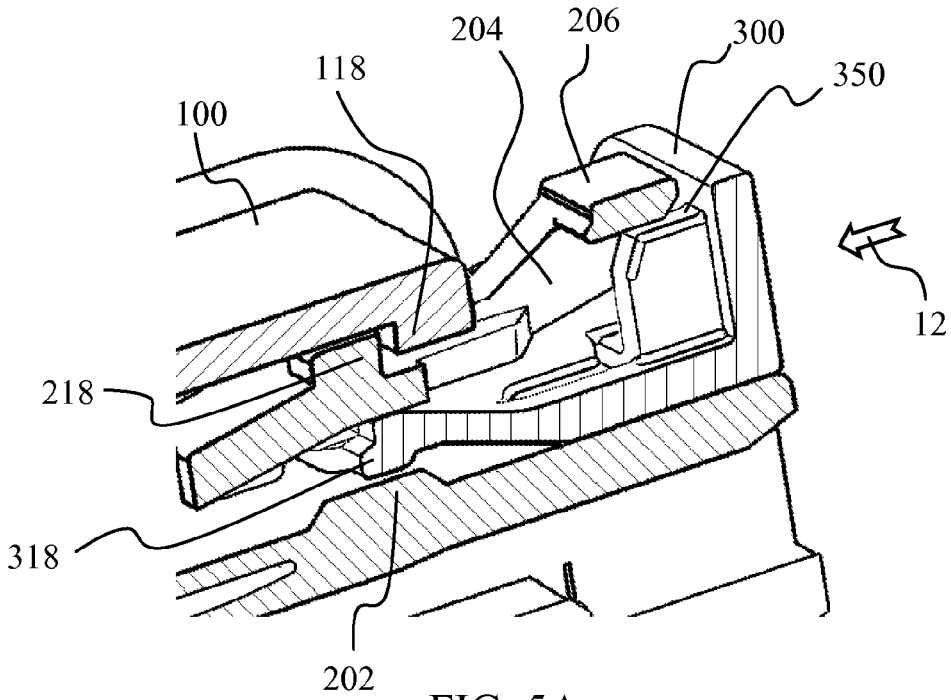
FIG. 5A is a partial cross-sectional perspective view showing a connector assembly of FIG. 1A when the CPA device is at the final-lock position.
Figure 5B:
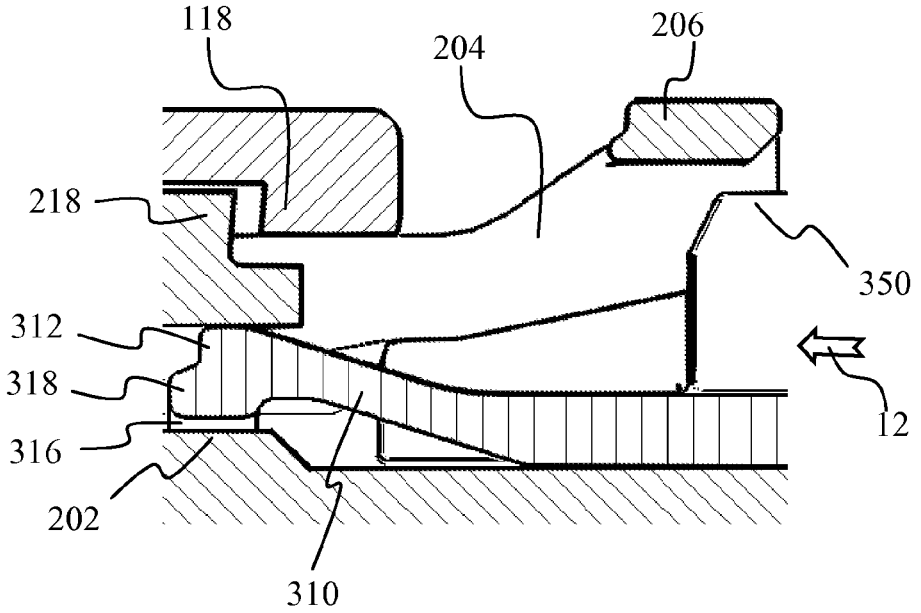
FIG. 5B is a partial cross-sectional side view of FIG. 5A.
Figure 5C:
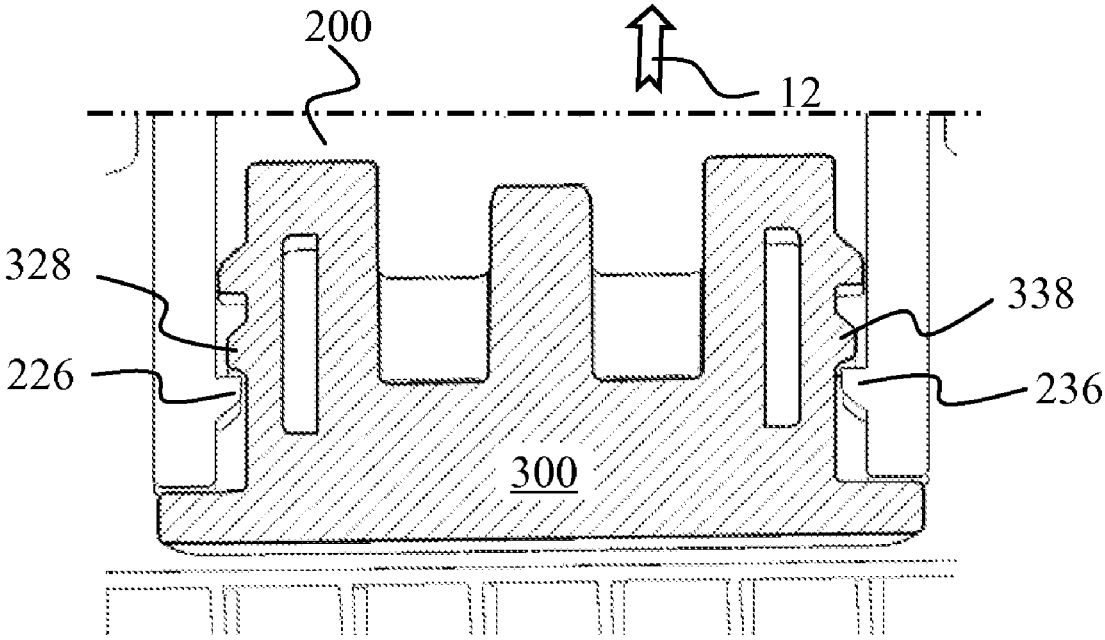
FIG. 5C is a partial cross-sectional top view of FIG. 5A.

As shown in FIGS. 5A, 5B and 5C, at the final-lock position, additional projections 340, 350 (only one additional projection 350 is shown in FIGS. 5A and 5B) are placed underneath press button 206 of second connector housing 200. Downward movement of second locking protrusion 218 is therefore prevented by front end 318. In addition, downward movement of press button 206 is prevented by additional protrusions 340 and 350. Accordingly, disengagement of first and second latch members 118 and 218 is prevented, hence first and second connector housings 100 and 200 are securely locked to each other.

When CPA device 300 is at the final-lock position, as shown in FIG. 5C, first and second final lock lugs 328 and 338 act against lateral protrusions 226 and 236 of second connector housing 200. By this engagement, CPA device 300 is fixed to second connector 200 at the final lock position.

Although embodiments of the present invention have been illustrated in conjunction with the accompanying drawings and described in the foregoing detailed description, it should be appreciated that the invention is not limited to the embodiments disclosed, and is capable of numerous rearrangements, modifications, alternatives and substitutions without departing from the spirit of the invention as set forth and recited by the following claims.

The invention claimed is:

1. An electrical connector assembly comprising:

a first connector housing having sidewalls surrounding a cavity, one of the sidewalls having a latch member projecting inward into the cavity;

a second connector housing insertable into the cavity, the second connector housing having a locking lever connected thereto;

a connector position assurance (CPA) device coupled to the second connector housing, the CPA device having a base portion and a center prong projecting forwardly from the base portion, wherein before the second connector housing is inserted into the cavity, the CPA device is fixed to the second connector housing in a pre-lock position at which the locking lever is allowed to deflect relative to the second connector housing between a first position to engage with the latch member and a second position to disengage from the latch member; and wherein when the second connector housing is inserted into the cavity, the CPA device is released from the pre-locking position and movable to a final lock position at which, an end portion of the center prong is placed between the locking lever and the second housing to maintain the locking lever in the first position, wherein the first connector housing comprising a pair of ribs formed on said one of the sidewalls and projecting inward into the cavity;

the CPA device comprising a pair of lateral prongs extending perpendicularly from the end portion of the center prong, when the CPA device is at the pre-lock position, the end portion of the center prong abuts the locking lever to prevent the CPA device from moving towards the final lock position, and when the second connector housing is inserted into the cavity, the pair of ribs urge against the lateral prongs to release the end portion of the center prong from abutting the locking lever.

2. An electrical connector assembly comprising:

a first connector housing having sidewalls surrounding a cavity, one of the sidewalls having a latch member projecting inward into the cavity;

a second connector housing insertable into the cavity, the second connector housing having a locking lever connected thereto;

a connector position assurance (CPA) device coupled to the second connector housing, the CPA device having a base portion and a center prong projecting forwardly from the base portion, wherein before the second connector housing is inserted into the cavity, the CPA device is fixed to the second connector housing in a pre-lock position at which the locking lever is allowed to deflect relative to the second connector housing between a first position to engage with the latch member and a second position to disengage from the latch member; and wherein when the second connector housing is inserted into the cavity, the CPA device is released from the pre-locking position and movable to a final lock position at which, an end portion of the center prong is placed between the locking lever and the second housing to maintain the locking lever in the first position, wherein the second connector housing comprising a pair of lateral protrusions, and the CPA device comprising a pair of arms extending forwardly from the base portion, each arm having a pre-lock lug engageable with the pair of lateral protrusions to fix the CPA device in the pre-lock position, and wherein each arm having a final lock lug engageable with the pair of lateral protrusions to fix the CPA device in the final lock position.

3. The electrical connector assembly of claim 2, wherein the pair of arms being positioned at opposite sides of the center prong.

4. An electrical connector assembly comprising:

a first connector housing having sidewalls surrounding a cavity, one of the sidewalls having a latch member and a pair of ribs projecting inward into the cavity;

a second connector housing insertable into the cavity, the second connector housing having a locking lever connected thereto;

a connector position assurance (CPA) device coupled to the second connector housing, the CPA device having a base portion, a center prong projecting forwardly from the base portion and a pair of lateral prongs extending perpendicularly from an end portion of the center prong, wherein before the second connector housing is inserted into the cavity, the CPA device is fixed to the second connector housing in a pre-lock position at which the locking lever is allowed to deflect relative to the second connector housing between a first position to engage with the latch member and a second position to disengage from the latch member; and wherein when the second connector housing is inserted into the cavity, the pair of ribs urge against the pair of lateral prongs to release the CPA device from the pre-locking position.

5. The electrical connector assembly of claim 4, wherein the second connector housing comprising a pair of lateral protrusions, and the CPA device comprising a pair of arms extending forwardly from the base portion, each arm having a pre-lock lug engageable with the pair of lateral protrusions to fix the CPA device in the pre-lock position.

6. The electrical connector assembly of claim 5, wherein each arm having a final lock lug engageable with the pair of lateral protrusions to fix the CPA device in the final lock position.

7. The electrical connector assembly of claim 5, wherein the pair of arms being positioned at opposite sides of the center prong.

8. A connector position assurance (CPA) device coupled to a connector housing, the connector housing having a locking lever connected thereto and a pair of lateral protrusions formed thereon, the locking lever has a latch member, the CPA device comprising:

a base portion;

a center prong projecting forwardly from the base portion;

a pair of lateral prongs extending perpendicularly from an end portion of the prong;

a pair of arms extending forwardly from the base portion, each arm having a pre-lock lug and a final lock lug, the pre-lock lugs are engageable with the pair of lateral protrusions to fix the CPA device to the connector housing in a pre-lock position, the final lock lugs are engageable with the pair of lateral protrusions to fix the CPA device to the connector housing in a final lock position.

9. The electrical connector assembly of claim 8, wherein the center prong is deflectable relative to the connector housing between a first position at which the end portion engages with the latch member to prevent the CPA device to move from the pre-lock position to the final lock position, and a second position at which the end portion disengages from the latch member to allow the CPA device to move to the final lock position.

10. The electrical connector assembly of claim 9, wherein when the CPA device is in the final lock position the end portion of the center prong is placed between the latch member and the connector housing.

* * * * *